United States Patent [19]

Questel et al.

[11] Patent Number: 4,763,789

[45] Date of Patent: Aug. 16, 1988

[54] MAILER FOR INDICIA-CARRYING GLASS PLATE

[76] Inventors: Roger Questel, 136 E. 74th St., New York, N.Y. 10021; Gene P. Seidman, 33 Riverside Dr., Apt. 9FA, New York, N.Y. 10023

[21] Appl. No.: 104,795

[22] Filed: Oct. 5, 1987

[51] Int. Cl.[4] ..... B65D 85/38

[52] U.S. Cl. ..... 206/454; 40/589; 40/661; 206/459; 206/523; 206/588; 229/92.8

[58] Field of Search ..... 206/449, 454, 455, 456, 206/521, 523, 588, 592, 459; 40/616, 619, 582, 10 R, 10 D, 541, 589; 281/29; 229/92.8; 156/663

[56] References Cited

U.S. PATENT DOCUMENTS

| | | | |
|---|---|---|---|
| 2,646,876 | 7/1953 | Sparks | 229/92.8 X |
| 2,742,145 | 4/1956 | Blackburn et al. | 206/521 |
| 2,746,667 | 5/1956 | Murphy | 206/454 X |
| 2,761,558 | 9/1956 | McLean, Jr. | 206/456 |
| 3,261,456 | 7/1966 | Sparks | 206/523 |
| 3,286,905 | 11/1966 | Farukhi | 206/454 X |
| 3,521,812 | 7/1970 | Moers et al. | 206/588 |
| 3,647,279 | 3/1972 | Sharpless et al. | 40/10 D X |
| 3,713,238 | 1/1973 | Hyman et al. | 229/92.8 X |
| 3,939,978 | 2/1976 | Tomaswick | 206/454 |
| 4,240,240 | 12/1980 | Cohen | 206/523 X |
| 4,386,702 | 6/1983 | Schultz et al. | 206/523 |
| 4,506,823 | 3/1985 | Buchler | 206/454 X |
| 4,546,019 | 10/1985 | Schneider | 40/582 X |

*Primary Examiner*—Stephen Marcus
*Assistant Examiner*—Bryon Gehman
*Attorney, Agent, or Firm*—Michael Ebert

[57] ABSTRACT

A wedding invitation or other image-bearing product inscribed or otherwise printed on the face of an edge-bevelled glass plate nested within a well formed in a rigid foam-plastic block, the well being so placed as to create a rectangular frame bordering the glass plate. The block is covered by a pad of like material having the same rectangular dimensions to form a sandwich assembly. This assembly is inserted in and snugly held in a cardboard box to provide a mailer that may be safely sent to the party to whom the invitation or product is addressed.

6 Claims, 1 Drawing Sheet

MAILER FOR INDICIA-CARRYING GLASS PLATE

BACKGROUND OF THE INVENTION

1. Field of Invention:

This invention relates generally to wedding invitations and other image-bearing products to be mailed to an invited party, and more particularly to a mailer protectively housing an invitation inscribed, etched or otherwise printed on the face of a glass plate.

2. Status of Prior Art:

It is the common practice to extend a formal invitation to participate in a wedding, an art gallery opening, a couturier presentation or other formal affair. This invitation is usually printed on high-grade panelled paper stock, the invitation being inserted in an envelope and mailed to the invited party.

In modern life, a wedding invitation represents a status symbol; and while when inviting friends to, say, a cocktail party, one may often use for this purpose inexpensively printed "come to my party" form cards, this is never done with formal wedding invitations, for a wedding is a major social event.

Thus it is not at all uncommon to have wedding invitations prepared by an elite establishment such as Tiffany's whose very name conjures up jewelry of the highest quality and extravagant cost. Such invitations are engraved on folders of the finest paper stock and include delicate tissue inserts, ribbons and other flourishes which make it evident to the party invited to participate in the wedding that this is no ordinary affair but a momentous occasion.

One who receives an engraved invitation of this type will often display it on the mantelpiece in order to impress visiting neighbors and friends; for the wedding invitation is a status symbol that devolves, as it were, on the recipient. There is also a competitive spirit involved in wedding invitations, and one sometimes seeks by the sheer extravagance of the invitation, as by using gold leaf engraving, to outdo invitations from rival sources.

But however fancy or ornate the invitation, it is still a paper product, and invitations on paper stock have to a large degree lost power as a status symbol and fail, therefore, to make the sought-for impression. To draw a simple analogy: Cadillacs are now available in a middle class price range, and this brand has ceased to make any impact as a high class vehicle available only to the chosen few.

Moreover, even the most elaborate invitation on paper stock is discarded after it has served its purpose; for while the social event to which the recipient was invited may be memorable, the invitation thereto is not usually retained as memento.

SUMMARY OF INVENTION

The main object of this invention is to provide a wedding invitation or other formal announcement, silk screened, sandblasted, acid-etched or otherwise printed on the face of a glass plate, preferably formed of high-class float glass so that the invitation has permanence and may be treasured as a memento.

A significant feature of the invention is that the glass plate invitation or glass product, which is very fragile, is protectively housed in a cardboard box so that it may be mailed to the invited party without breaking or shattering thereof.

More specifically, it is an object of this invention to provide a mailer in which the glass plate invitation is protectively blanketed in rigid foam plastic material.

Briefly stated, these objects are attained in a wedding invitation or other image-bearing product inscribed or otherwise printed on the face of an edge-bevelled glass plate nested within a well formed in a rigid foam-plastic block, the well being so placed as to create a rectangular frame bordering the glass plate. The block is covered by a pad of like material having the same rectangular dimensions to form a sandwich assembly. This assembly is inserted in and snugly held in a cardboard box to provide a mailer that may be safely sent to the party to whom the invitation or product is addressed.

BRIEF DESCRIPTION OF DRAWINGS

For a better understanding of the invention as well as other objects and further features thereof, reference is made to the following detailed description to be read in conjunction with the accompanying drawings, in which.

DESCRIPTION OF INVENTION

Figure 1:
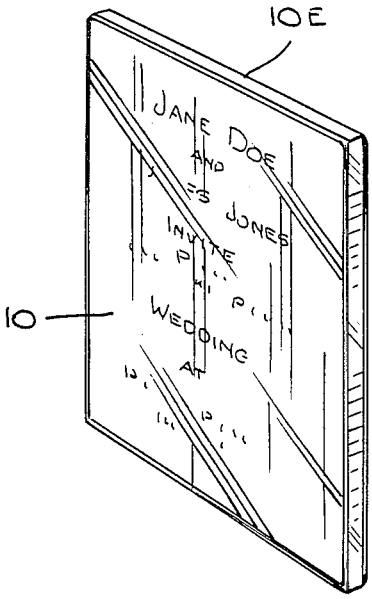
FIG. 1 is a perspective view of a glass plate invitation in accordance with the invention.

Mailer:

Referring now to FIG. 1, an invitation in accordance with the invention is inscribed, sandblasted, acid-etched, silk-screened or enamel-baked or otherwise printed on the front face of a glass plate 10 of float glass or crystal. The rectangular dimensions of the plate are in a standard invitation size; that is, $4\frac{1}{2}\times 6$ inches, although the invention is not limited to these dimensions. Plate 10 has a thickness of at least $\frac{1}{8}$ of an inch, so that the plate is durable and not easily fractured.

All edges 10E of the plate, both on the front face and the rear face are bevelled; hence the plate has no sharp edges and can be safely handled. The glass is preferably float glass and may include cobalt or other coloring agent to afford the glass an attractive hue to contrast with and highlight the printing thereon.

While in the example shown, the invitation is to a wedding, in practice it may be to any other social event to which the addressed party is invited to attend. Or inscribed on the glass plate may be a menu, an award, a baby's footprint or any other text or image which is rendered more impressive by being formed on a glass plate.

Figure 2:
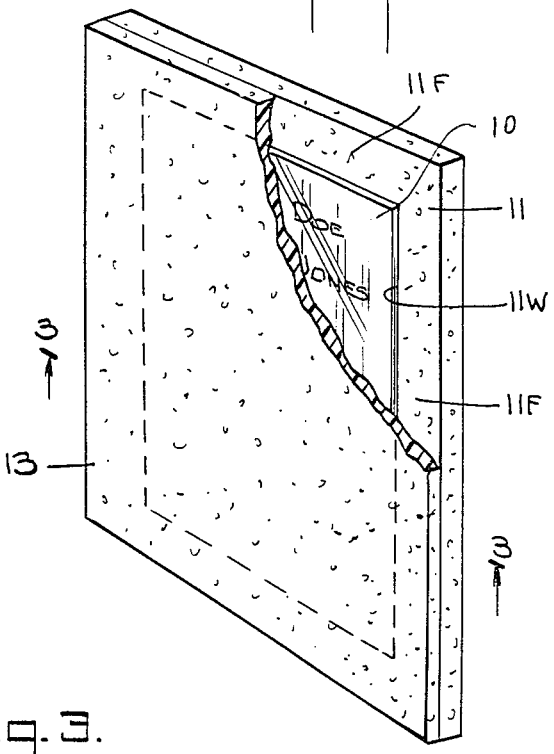
FIG. 2 shows the glass plate nested within the well of a protective block covered by a pad to form a sandwich assembly.
Figure 3:
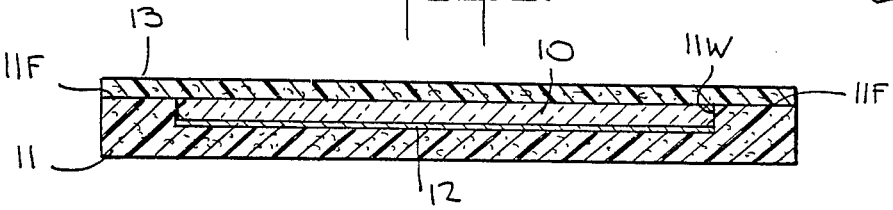
FIG. 3 is a section taken through FIG. 2 in the plane indicated by lines 3—3.

As shown in FIG. 2, invitation plate 10 is snugly nested within a rectangular well 11W formed within a block 11 of relatively rigid, synthetic plastic foam material. The well is so placed in the block as to create a rectangular frame 11F about the plate which borders the invitation.

Underlying glass plate 10 in well 11W is a thin card 12 of smooth white paper to provide a somewhat reflective backing for the plate. Hence a shadow impression of the printing on the front face of the plate is cast on card 12 to impart the impression of depth to the invitation. In practice, card 12 may have metallic foil laminated to the face thereof to enhance this impression or a card of any color.

Figure 4:
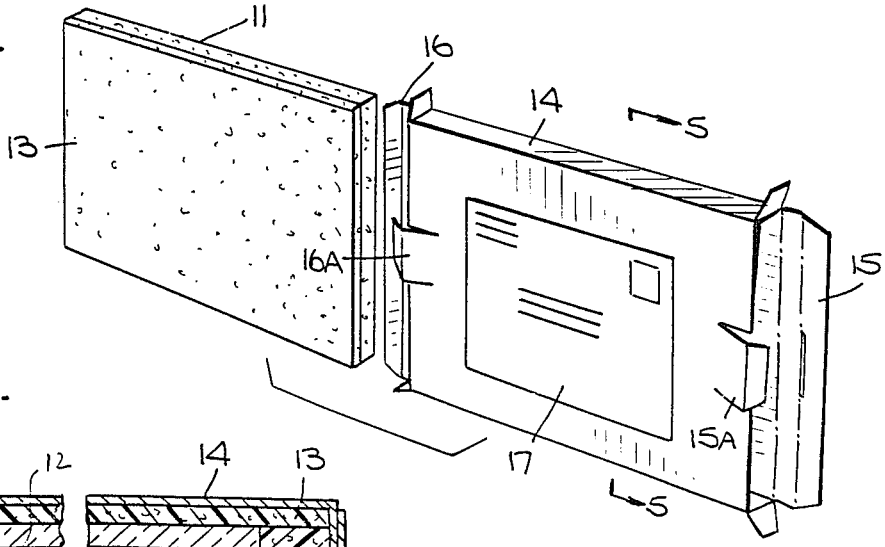
FIG. 4 shows the mailer box for the glass plate assembly.
Figure 5:
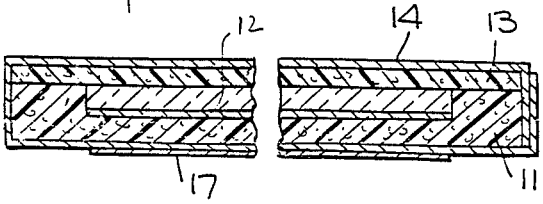
FIG. 5 is a section taken through the loaded box.

Overlying block 11 and covering the glass plate is a thinner pad 13 of the same foam plastic material whose rectangular dimensions correspond to those of the block. Hence the glass plate 10 is protectively sandwiched by block 11 and pad 13 to form a shipping assembly. This assembly is snugly received in a box formed of stiff cardboard 14 to form a mailer, as shown in FIGS. 4 and 5. The box is provided with foldable end flaps 15 and 16 and locking tabs 15A and 16A which go into slots in the flaps to securely close the ends of the box without the use of adhesive. Thus the recipient of the mailer can readily open the ends of the box to push out the assembly housed therein. A mailing label 17 is adhered to the face of the box to identify the sender and the addressee.

While the foam plastic package for the glass plate is somewhat flexible, flexure thereof is resisted by the stiff cardboard box, and the mailer can therefore withstand very rough handling in transit without endangering the integrity of the glass plate. And because the foam plastic is lightweight it does not add substantially to mailing costs.

When the recipient removes the assembly from the box and lifts pad 13, he sees the glass plate invitation framed within block 11. And when he removes the plate from the block, he then has in his hands a striking invitation to a wedding or whatever other festive affair to which he is invited to participate.

And because the invitation is permanent in form and both unusual and attractive, it may be retained as a memento of the affair. The printing on the glass plate may include colored ornamentation in figurative or abstract form to augment the appeal of the invitation.

Also, one may include in the mailer a protective paper overlay and a card having printed thereon the address of the facility where the wedding or other social event is being held and travel directions thereto, so that the printing on the glass plate may be confined to the date, time and nature of the social event. All other relevant instructions appear on the printed card. One may also insert in the box an R.S.V.P. card and self-addressed envelope therefor.

This mailer may also be used for advertising and promotional purposes. While most potential subscribers, say, to a magazine such as "Connoisseur" or other quality publications, tend to discard mailed advertisements as junk mail without bothering to read the contents, upon receiving a mailer in accordance with the invention, they are far more likely to pay attention to the advertisement.

Imaging Techniques:

In the case of a wedding invitation, the couple to be married may prefer to send a glass invitation to all friends and relatives invited to the ceremony. In this instance, the type is silk-screened onto the glass plate in 22 karat gold, silver or in any other metallic or non-metallic color and then baked at about 1100° F. to permanently bond the applied color to the glass.

In the case of an engaged couple who wish a single glass plate wedding invitation for themselves or a few for the bridal party, or in the case of individuals who would like as a memento a copy of a store-bought paper invitation transferred to and etched in a glass plate, a different technique is employed.

In this process, the text of the invitation is photographically transferred onto an acetate positive film such as "KODALITH" produced by the Eastman Kodak Company. The text then appears in black type on clear acetate film.

The glass plate that is to carry this text is first coated with a light-sensitive photo emulsion which is allowed to dry. This dried emulsion functions as a sandblasting resist. A suitable resist for this purpose is SBX marketed by CHROMOLINE Corp. The KODALITH film with the type thereon in black is placed on the emulsion-coated surface of the glass. The film is held in place by a vacuum pump and is exposed to ultraviolet light (i.e., 371 nanometers) for approximately 4 minutes. This UV irradiation functions to harden all areas of the emulsion except those zones which are protectively masked by the black type or image.

The zones of the emulsion not hardened by exposure to ultraviolet light are washed away with a high-pressure water spray to uncover the underlying glass zones. Then the surface is sandblasted to inscribe the test or image onto the uncovered glass zones. After sandblasting is completed, the areas on the glass surface covered by the resist are removed by a suitable solvent.

At this point, the sandblasted zones on the glass plate which define the text or image transferred thereto may be colored by spreading a wax-based paint across the entire surface of the glass plate and wiping away the excess, the wax-based paint adhering only to the porous sandblasted zones. A suitable wax-based paint for this purpose is "Rub N Buff" marketed by The American Art Clay Company, Inc.

This process makes it possible to transfer any text or image to glass, including the half tones of a photograph. The process is usable not only for wedding invitations, but also for awards, corporate promotions, menus, financial tombstones, portraits and a baby's foot print. Thus the invention is by no means limited to glass plate wedding invitations, for it is applicable to any plate-like product intended to make an impression on the recipient or to be kept as a memento. All of these products involve the transfer of a text or an image onto a glass plate and its safe arrival by means of the glass plate mailer at its final destination.

Baby Footprint Kit:

When the image on the glass plate is to be the footprint of a newborn baby, the parents may be provided with a kit which makes it possible for them to produce a footprint on a 6×6 piece of glass, one quarter of an inch thick.

To this end, the kit includes a 6×6 white paper card and a baby foot inker as well as a mailing envelope. After inking the baby's foot, an ink impression thereof is made on the white card which is then mailed to a processor who transfers the footprint to a glass plate in the manner previously described using a sandblasting technique.

The parents can also write "SALLY—born 6/30/87" or whatever other data they choose to record, and this text will also be sandblasted into the glass plate which may be pink or blue glass, depending on the gender of the baby, or clear glass. In the case of clear glass, wax-based paint in an appropriate color may be introduced into the sandblasted areas.

The final product is then mailed by the processor in the glass plate mailer to the parents. The mailer may include a rectangular easel base of brushed aluminum or other attractive material having a transverse slot therein into which is insertable the lower edge of the glass plate to hold the plate in an upright position.

While there has been shown and described a preferred embodiment of a glass plate mailer in accordance with the invention, it will be appreciated that many changes and modifications may be made therein without, however, departing from the essential spirit thereof.

I claim:

1. A shipping assembly and a box therefor comprising:

A. a transparent glass plate having printed or inscribed on its front face a text such as an invitation to a wedding or an image such as a baby foot print, said plate having rectangular dimensions and a thickness of less than a half inch appropriate to an invitation which renders the plate durable, all edges of the plate being bevelled to avoid sharp edges;

B. a rectangular block formed of relatively rigid foam plastic material having a well therein whose rectangular dimensions substantially match those of the plate, said plate being nested in the well with its printed face exposed, said well being so placed in the block as to create a rectangular frame bordering the plate;

C. a pad of the same material as the block and having the same rectangular dimensions as that of the block, said pad overlying the plate to define a protective enclosure therefor to complete the assembly; and D. a cardboard box whose dimensions are such as to snugly receive the assembly, said box being formed by a rectangular sleeve provided with foldable end flaps and locking tabs to enclose the ends of the sleeve without adhesive, whereby a recipient can readily open the ends of the box to push out the assembly housed therein.

2. An assembly and a box therefor as set forth in claim 1, wherein said printing is silk screened in the plate.

3. An assembly and a box therefor as set forth in claim 1, wherein said text or image is sand-blasted or acid etched on the plate.

4. An assembly and a box therefor as set forth in claim 1, further including a reflective card in the well underlying the plate and independent thereof to provide a shadow impression of the printing and impart apparent depth thereto when the plate is nested in the well.

5. An assembly and a box therefor as set forth in claim 1, wherein said glass has a float glass composition.

6. An assembly and a box therefor as set forth in claim 1, wherein said glass composition includes a coloring agent to impart a hue thereto.

* * * * *